US009746272B2

(12) United States Patent
Lowrance et al.

(10) Patent No.: US 9,746,272 B2
(45) Date of Patent: Aug. 29, 2017

(54) MUZZLE FLASH SIMULATOR AND METHOD FOR AN IMITATION MACHINE GUN

(71) Applicant: Pathfinder Systems, Inc., Arvada, CO (US)

(72) Inventors: Kyle Lowrance, Westminster, CO (US); C. Ross Cohlmia, Arvada, CO (US)

(73) Assignee: Pathfinder Systems, Inc., Lakewood, CO (US)

( * ) Notice: Subject to any disclaimer, the term of this patent is extended or adjusted under 35 U.S.C. 154(b) by 135 days.

(21) Appl. No.: 14/542,115

(22) Filed: Nov. 14, 2014

(65) Prior Publication Data

US 2016/0138884 A1 May 19, 2016

(51) Int. Cl.
*F41A 33/02* (2006.01)

(52) U.S. Cl.
CPC ..... *F41A 33/02* (2013.01)

(58) Field of Classification Search
CPC ..... F41A 33/02
USPC ..... 434/11, 16, 18, 19, 21
See application file for complete search history.

(56) References Cited

U.S. PATENT DOCUMENTS

| | | | | | |
|---|---|---|---|---|---|
| 5,842,300 | A * | 12/1998 | Cheshelski | F41A 33/02 | 42/116 |
| 5,947,738 | A * | 9/1999 | Muehle | F41A 33/02 | 124/57 |
| 6,146,141 | A * | 11/2000 | Schumann | F41A 33/06 | 434/11 |
| 6,406,298 | B1 * | 6/2002 | Varshneya | F41G 1/35 | 434/19 |
| 7,581,954 | B2 * | 9/2009 | Schavone | F41B 11/51 | 124/74 |
| 8,690,575 | B1 * | 4/2014 | Gurule | F41A 33/06 | 434/11 |
| 9,163,904 | B2 * | 10/2015 | Ohr | F41A 17/44 | |
| 9,291,420 | B1 * | 3/2016 | Jensen | F41G 3/26 | |
| 9,435,604 | B2 * | 9/2016 | Zusman | F41A 33/00 | |
| 2008/0187888 | A1 * | 8/2008 | Jones | F41A 33/02 | 434/21 |
| 2014/0234806 | A1 * | 8/2014 | McBride | F41A 33/00 | 434/11 |
| 2014/0272806 | A1 * | 9/2014 | Hunt | F41A 33/00 | 434/16 |
| 2015/0170540 | A1 * | 6/2015 | Ford | G09B 9/003 | 434/22 |

* cited by examiner

*Primary Examiner* — Kurt Fernstrom
(74) *Attorney, Agent, or Firm* — Dorr, Carson & Birney PC

(57) ABSTRACT

A muzzle flash from firing a live ammunition round from an actual machine gun is stimulated in an imitation machine gun by locating a LED light source within a flash suppressor attached to a muzzle end of a barrel of the imitation machine gun. When energized, the light source emits a burst of light through vents in the flash suppressor. A plurality of LEDs create the burst of light.

11 Claims, 5 Drawing Sheets

MUZZLE FLASH SIMULATOR AND METHOD FOR AN IMITATION MACHINE GUN

CROSS REFERENCE TO RELATED APPLICATION

This invention is related to an invention for a Recoil Simulator and Method for an Imitation Machine Gun, described in U.S. patent application Ser. No. 14/541,515, filed concurrently herewith, and assigned to the assignee of the present invention. The subject matter of this prior application is incorporated herein fully by this reference.

FIELD OF THE INVENTION

This invention relates generally to training persons to operate an actual machine gun by using an imitation or simulated machine gun. More particularly, the present invention relates to a new and improved muzzle flash simulator and method which simulates, in the imitation machine gun, the flash of light from the muzzle created by firing actual ammunition rounds from an actual machine gun.

BACKGROUND OF THE INVENTION

In modern circumstances, it is difficult and expensive to train soldiers and military defense personnel in the effective use of high-powered rapid-fire machine guns, by simply allowing such individuals to practice using the actual guns with live ammunition. The ammunition rounds are expensive, for example costing up to five dollars per round. The cost of ammunition alone quickly multiplies when it is recognized that a typical machine gun is capable of firing hundreds of rounds per minute. Adequate space for a practice gunnery range may not be readily available. Significant costs are involved in transporting the personnel and the equipment to suitable remote locations where adequate gunnery practice can be performed. Safety is always a major consideration when live ammunition rounds are fired, both to military personnel involved in gunnery practice and to non-military personnel who may be adjacent to the gunnery range. It is difficult to instruct during a live ammunition training session due to the noise and safety considerations involved when others are involved in similar, close-by, live-ammunition practice activities. Furthermore, it may be difficult to vary the targets quickly at a live-ammunition gunnery range.

These problems and practical constraints are exacerbated when training individuals to shoot from a moving vehicle such as a helicopter. If live ammunition practice is attempted from a moving helicopter, a large space is required in order to maneuver the helicopter and to provide targets and adequate safety barriers, especially when multiple individuals are involved in similar simultaneous training exercises. As a result, live gun practice requires considerable space, and the cost of operating the helicopter greatly multiplies the overall training cost.

Because of these and other considerations, simulated weapon training programs have been developed for teaching purposes. Such training programs use imitation machine guns which closely simulate the sensational aspects and the mechanical and physical requirements of firing actual machine guns. Firing is simulated by reproducing effects which mirror the sensual perceptions associated with firing the actual machine gun. The environment and the targets are electronically displayed, allowing them to be more easily varied and to simulate movement of the targets and the machine gun. The trajectory of the simulated bullet fired is also calculated. In those cases where the simulated fired bullet emulates a tracer, the trajectory of that simulated bullet is also displayed in the surrounding environment.

For helicopter gun training, the imitation machine gun is mounted in an open door of an imitation portion of the helicopter fuselage. The environment and the targets are displayed outside of the open door. The portion of the imitation helicopter fuselage is moved or shaken in a manner similar to the movement of an actual helicopter in flight while the display of the surrounding environment and the targets are moved to simulate the flight path of the helicopter.

Simulated weapons training programs offer other benefits. Environments of remote areas of the world may be simulated, thereby providing training exposure to such environments prior to actually deploying the military personnel to those locales. The accuracy of the training program and the abilities of the individuals trained may be assessed. The accuracy in shooting, and the success of the training itself, is gauged by comparing the calculated, projected trajectory of the simulated bullets relative to the displayed targets. The number of simulated rounds fired may also be counted to evaluate the efficiency of the individual doing the shooting. Other factors can be evaluated from the vast amount of information available from such computer-based simulated weapons training programs.

Of course, to be effective for training purposes, it is necessary to create a realistic simulated environment and a realistic experience of firing the imitation machine gun. Such simulation is accomplished principally by multiple computer systems which are programmed to perform their specific simulation activities in coordination with each other. In the end, the capability of the simulated weapons training program to imitate the actual use of the actual machine gun in an actual environment is the ultimate measure of effective and successful training.

Individuals become accustomed to the imitation machine gun due to the amount of simulated training received. Because of the familiarity gained from training with the imitation machine gun, use of the imitation machine gun should be essentially the same as the use of the actual machine gun; otherwise, differences in functionality or performance create unexpected problems or difficulties when using the actual machine gun.

Accurate simulation of firing an actual machine gun involves duplicating the recoil or reactive impact from firing each ammunition round, duplicating the sound of the explosion of firing each round, and duplicating the flash of light created when the bullet exits the muzzle end of the barrel. The recoil impacts are simulated by a recoil simulation device which shakes the imitation machine gun. The sound of firing each round is duplicated by an audio speaker attached within or close to the imitation machine gun. However, duplicating the burst of light from a muzzle flash has proven somewhat problematic.

While light sources in the environment surrounding the imitation machine gun can be controlled to deliver momentary flashes of light, the light does not create the intensity and sensual effect as occurs with an actual machine gun when sighting along the barrel. The highest intensity of the muzzle flash occurs at the muzzle end of the barrel and dissipates from their into the environment, which is essentially the opposite sensation of the light intensity distribution when light sources in the surrounding environment attempt to duplicate the muzzle flash.

Realistic muzzle flash simulation is particularly important in training for night operations using an actual machine gun. At night, the machine gun operator typically wears night vision goggles. The intensity of the light of an actual muzzle flash has the effect of momentarily blanking the visual effects from the night vision goggles. The operator is essentially momentarily blinded by each actual muzzle flash. To be effective, they operator must become accustomed to the momentary blanking of the night vision goggles. The operator may become disoriented or at least distracted if the operator has not become accustomed to the momentary blanking effects in the night vision goggles. Delivering momentary flashes of light from light sources in the environment surrounding the imitation machine gun is not as effective in blanking the night vision goggles as when the burst of light is emitted from the muzzle of the actual machine gun.

One of the constraints in simulating a realistic muzzle flash is that the highest intensity from the muzzle flash should be at or near the muzzle end of the barrel of the imitation machine gun, in order to simulate accurately the intensity of light from an actual muzzle flash. The light sources used to simulate the muzzle flash should also attempt to replicate the high light intensity from an actual muzzle flash. While the high intensity light can be delivered from a variety of light sources, those light sources may be so large physically that they must be attached separately to the barrel. Extra components connected to the imitation machine gun can cause a lack of familiarity or awkwardness in the use of the actual machine gun. Extra components may create an expectation of a certain feel, appearance and operating style that are not present when using the actual machine gun, and those differences may lead to degraded performance of the user in actual circumstances. Suitable light sources should have the capability of delivering repeated momentary bursts of light, without residual light emission after each burst is completed. Residual light emission after the burst has the effect of prolonging the blanking effect in night vision goggles. Light sources using filaments have a tendency for residual light emission from the heated filament after the pulse of energy has terminated. Suitable light sources must also have the capability of repeated and reliable long-term use.

SUMMARY OF THE INVENTION

In accordance with the above described and other related considerations, the present invention involves effectively simulating the muzzle flash of an actual machine gun in an imitation machine gun used in a simulated weapons training program. The light available from the present invention originates from the muzzle end of the barrel of the imitation machine gun, just as is the case when firing live ammunition rounds from an actual machine gun. The burst of light is of high intensity and is comparable to the intensity of light emitted from firing a live ammunition round. The light source used in simulating the muzzle flash is small enough to fit within the muzzle of the imitation machine gun, yet still capable of creating a high intensity burst of light. The intensity distribution and sensations of the simulated muzzle flash allow the user to acclimate so that firing the actual machine gun is not an unusual sensation, particularly when using night vision goggles. The blanking effect in night vision goggles is effectively duplicated because of the comparable intensity characteristics of the simulated muzzle flash and an actual muzzle flash. The light source is turned on and off quickly to simulate each muzzle flash without the effects of residual light emission, thereby avoiding a sensation different from firing an actual machine gun. Locating the light source in the muzzle end of the barrel of the imitation machine gun avoids a difference in the look and feel of the imitation machine gun compared to the actual machine gun. The components used are capable of reliable intensive use without premature or unexpected failure, thereby facilitating the effectiveness of the imitation machine gun for training purposes.

The present invention constitutes a muzzle flash simulator which is adapted for use in an imitation machine gun. The imitation machine gun has a barrel and a flash suppressor attached to a muzzle end of the barrel. The muzzle flash simulator comprises a light source which when energized emits a burst of light and a housing within which the light source is positioned. The housing is adapted to fit within the flash suppressor.

The muzzle flash simulator may include some or all of the following additional features. The burst of light is emitted through vent slots in the flash suppressor. The light source comprises a plurality of LEDs. The plurality of LEDs are arranged in an LED array device, and a plurality of LED array devices are used. Each LED array device includes anode and cathode electrodes to conduct current through the LEDs. Current conducting rails are positioned to separately contact the anode and cathode electrodes. Each rail comprises a bow portion and base portion which are separated by a slot, and the bow portion extends convexly relative to the base portion. The anode and cathode electrodes contact the bow portion of each rail above a base plate which supports the rails. Each LED array device is pressed against the bow portions of each rail to retain the anode and cathode electrodes in contact with the bow portions of the rails. The bow portion of each rail is resiliently deformable to press against the anode and cathode electrodes. Each LED array device comprises a substrate upon which the LEDs and the anode and cathode electrodes are formed. A lens extends over the array of LEDs on the substrate. Pressure is applied to the lens to contact the anode and cathode electrodes with the rails. A glass panel and a retaining frame apply the pressure to the lens of each LED array device. A tubular housing contains the LED array devices, the rails and the base plate, and the tubular housing fits within a cylindrical opening in the flash suppressor. A disk formed of opaque material is positioned at an end of the tubular housing adjacent to the distal end of the flash suppressor.

The present invention also constitutes a method of simulating a muzzle flash from firing a live ammunition round from an actual machine gun in an imitation machine gun. The imitation machine gun has a barrel with a flash suppressor attached to the muzzle end of the barrel. The method comprises locating a light source within a flash suppressor, and energizing the light source to emit a burst of light through the flash suppressor. The burst of light has an intensity which simulates the intensity of a burst of light from firing a live ammunition round from an actual machine gun.

The method of simulating the muzzle flash may also include some or all of the following additional features. A plurality of LEDs are used as the light source. The plurality of LEDs are included in each of a plurality of LED array devices, with each LED array device including an array of LEDs. The plurality of LED array devices are retained within a transparent or translucent cylindrical housing which fits within the flash suppressor. Electrical energy is conducted to the LED array devices through rails retained on the base plate. The LED array devices are pressed into electrical contact with the rails. The base plate and the rails are located within the cylindrical housing. A lens of each LED array device covers the array of LEDs of that device, and pressure is applied to the lens to press the LED array devices into contact with the rails.

Other aspects and features of the invention, and a more complete appreciation of the present invention, as well as the manner in which the present invention achieves the above and other improvements, can be obtained by reference to the following detailed description of a presently preferred embodiment of the invention taken in connection with the accompanying drawings which are briefly summarized below, and by reference to the appended claims.

DETAILED DESCRIPTION

Figure 1:
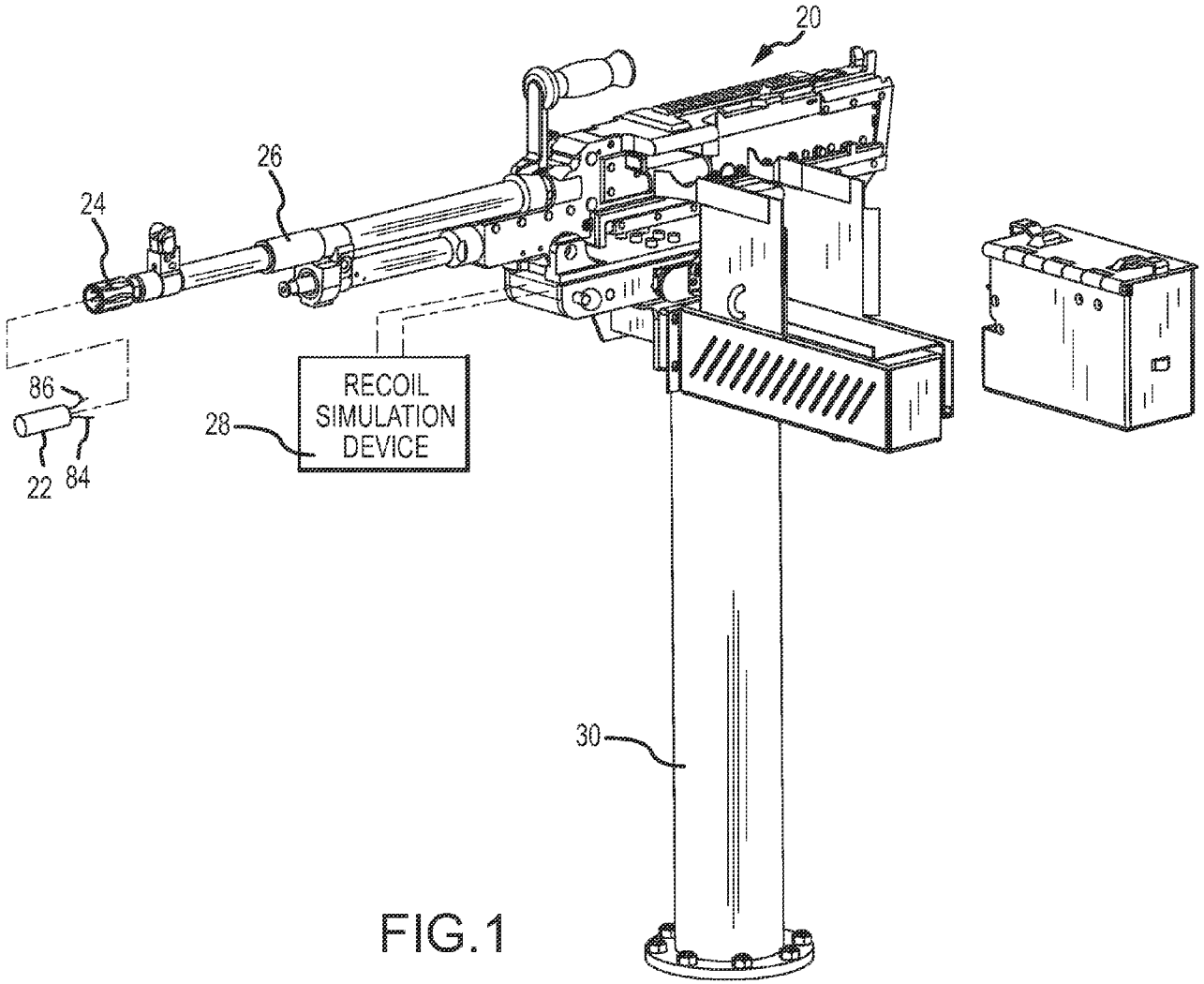
FIG. 1 is a generalized perspective view of an exemplary imitation machine gun which incorporates a muzzle flash simulator, shown exploded from a muzzle end of a barrel of the imitation machine gun, and which exemplifies a method according to the present invention.

An exemplary imitation machine gun 20 which is used in simulated weapons training activities is shown in FIG. 1. The machine gun 20 duplicates the look and feel and the mechanical features of an actual machine gun which it imitates. The machine gun 20 includes a muzzle flash simulator 22 (FIGS. 2-4), which fits within a flash suppressor 24 located on a distal or muzzle end of a barrel 26 of the imitation machine gun 20. The muzzle flash simulator 22 emits bursts of high-intensity light which emulates each flash of light created by firing an actual ammunition round from an actual machine gun.

Figure 4:
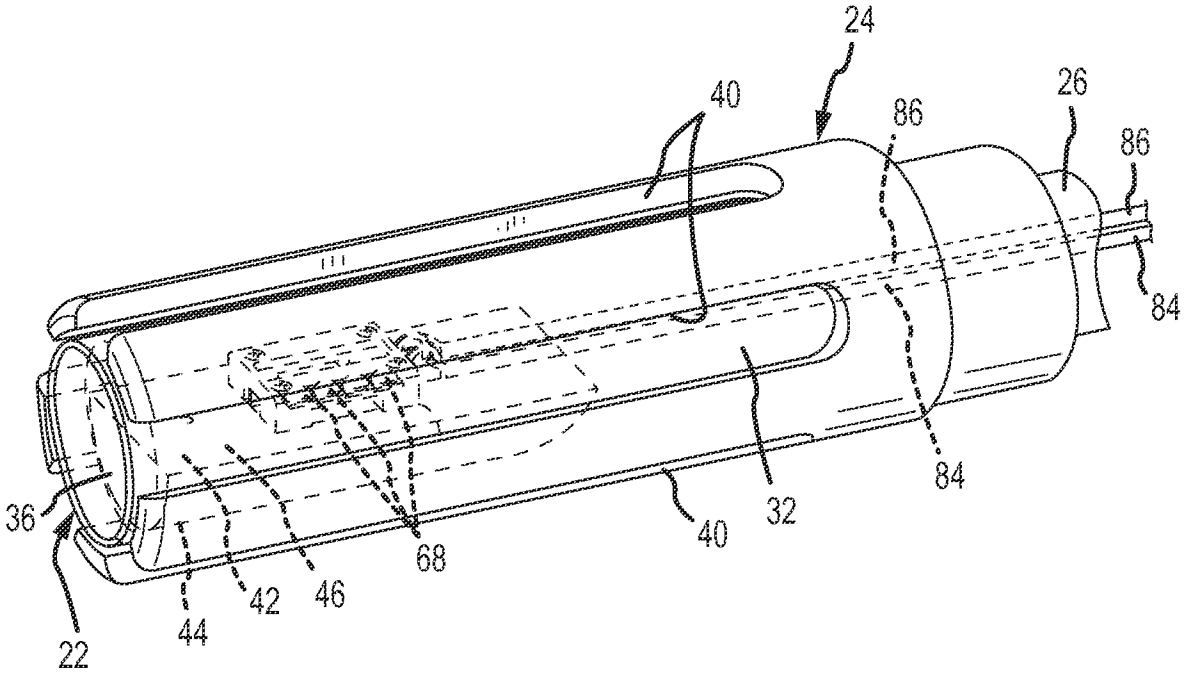
FIG. 4 is a perspective view of the muzzle flash simulator shown in FIGS. 1, 2 and 3, in an assembled relationship with the muzzle flash suppressor shown in FIGS. 1 and 2.

The muzzle flash simulator 22 is concealed within the flash suppressor 24 (FIG. 4). The flash suppressor 24 is used in an actual machine gun to dissipate the compressed gas and burst of light created by the exploded gunpowder from firing an actual ammunition round. Since there is no such explosion when firing the imitation machine gun 20, the muzzle flash simulator 22 emulates the burst of light. Audio speakers (not shown) simulate the audible effects of the explosion. A recoil simulation device 28 (FIG. 1) simulates the recoil of firing an actual machine gun by shaking or reciprocating the gun 20 in a forward and backward direction each time a simulated round is fired. The muzzle flash simulator 22 creates a flash of light simultaneously with each reactive impact generated by the recoil simulator 28. Details of a preferred recoil simulator 28 are described in the above described cross-referenced US patent application.

The imitation machine gun 20 is supported by a support pedestal 30. The support pedestal 30 is attached to a floor or other support structure which emulates the actual environment in which the actual machine gun will be used, for example an opening in the side of a helicopter fuselage. A user stands behind the gun 20 and sights along the barrel 26 when firing. The bursts of light generated by the muzzle flash simulator 22 are perceived by the user of the gun 20 in the same manner as bursts of light would be perceived by the user of an actual machine gun.

Figure 2:
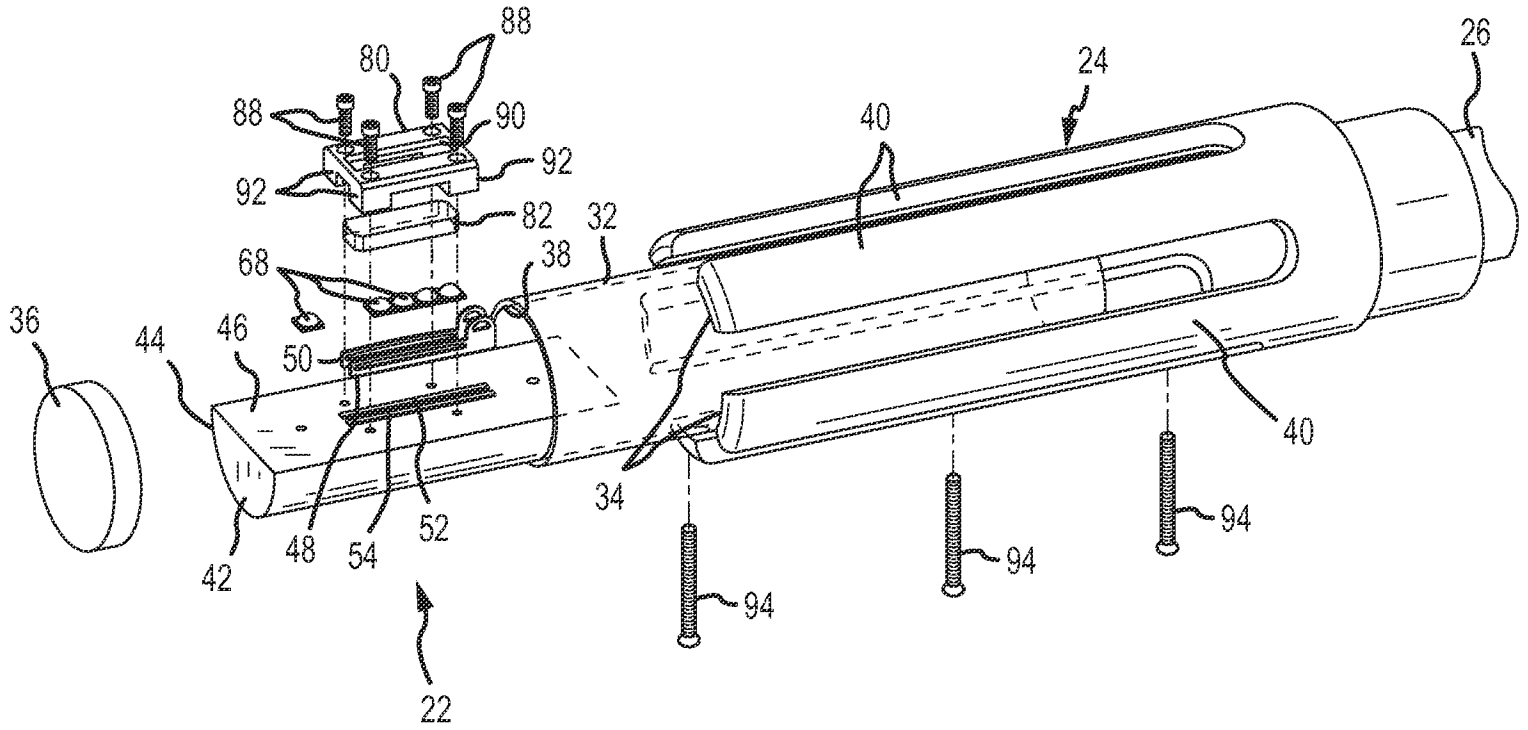
FIG. 2 is an enlarged exploded perspective view of the muzzle flash simulator and a partial view of a muzzle flash supressor of the gun shown in FIG. 1.
Figure 3:
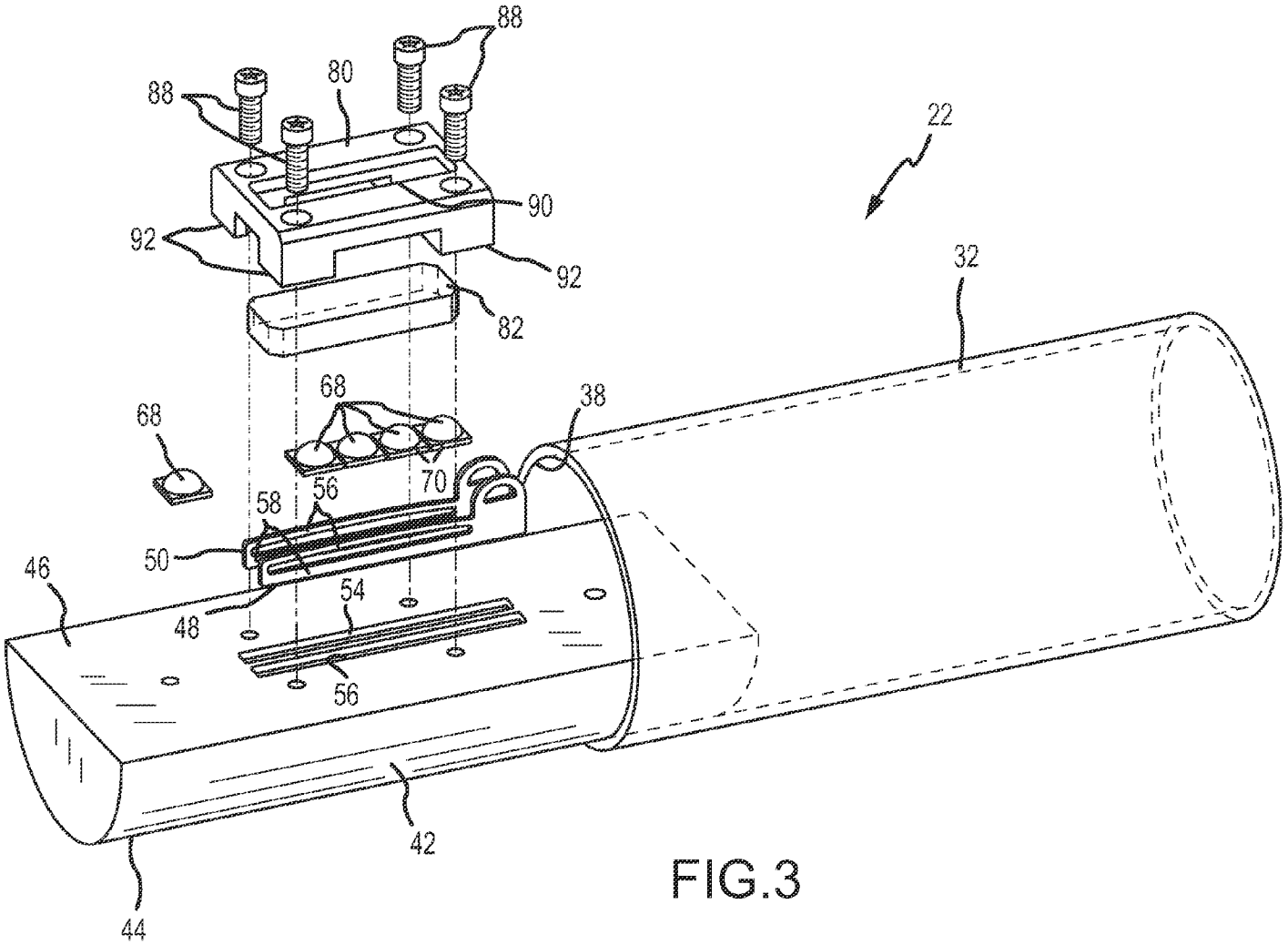
FIG. 3 is an a further enlarged exploded perspective view of the muzzle flash simulator shown in FIGS. 1 and 2.

The muzzle flash simulator 22 is shown in greater detail in FIGS. 2-4. A tubular housing 32 contains the elements of the muzzle flash simulator 22. The tubular housing 32 is preferably formed of heat-resistant transparent polycarbonate material. The tubular housing 32 is machined to exactly fit within an interior cylindrical opening 34 of the flash suppressor 24. A cylindrical end disk 36 is rigidly retained at an outside end of an open cylindrical interior 38 of the tubular housing 32. The end disk 36 is preferably formed of opaque heat resistant material. The opaque end disk 36 blocks the transmission of the light bursts from the muzzle flash simulator 22 that would otherwise pass directly out of the muzzle end of the barrel 26 and the flash suppressor 24. Instead, the bursts of light from the muzzle flash simulator 22 are emitted from longitudinal vent slots 40 which extend from the interior opening 34 to the outside of the flash suppressor 24. The bursts of light from the muzzle flash simulator 22 are emitted from the flash suppressor 24 and transversely relative to the barrel 26, and thereby influence the user of the imitation machine gun 20 in the same manner as the bursts of light from firing actual ammunition rounds influence the user of an actual machine gun.

A base plate 42 is positioned within the open interior 38 of the tubular housing 32 at a position adjacent to the end disk 36. The base plate 42 as an exterior cylindrically curved surface 44 that coincides with the curvature of the open interior 38 of the tubular housing 32. The curved surface 44 of the base plate 42 rests against the tubular housing 32 at the open interior 38. An inner top flat surface 46 of the base plate 42 extends between the opposite edges of the curved surface 44. The base plate 42 functions as a heat sink, and is preferably formed from heat resistant material such as boron nitride.

Two electrical distribution rails 48 and 50 are located respectively in longitudinally extending slots 52 and 54 which are formed into the base plate 42 at the top surface 46. The slots 52 and 54 retain the rails 48 and 50 in an upright manner relative to the base plate 42. Each rail 48 and 50 is formed of an electrically conductive and thermally resistive material such as copper. Preferably, each rail 48 and 50 has been etched or otherwise formed from a layer of sheet copper material.

Figure 5:
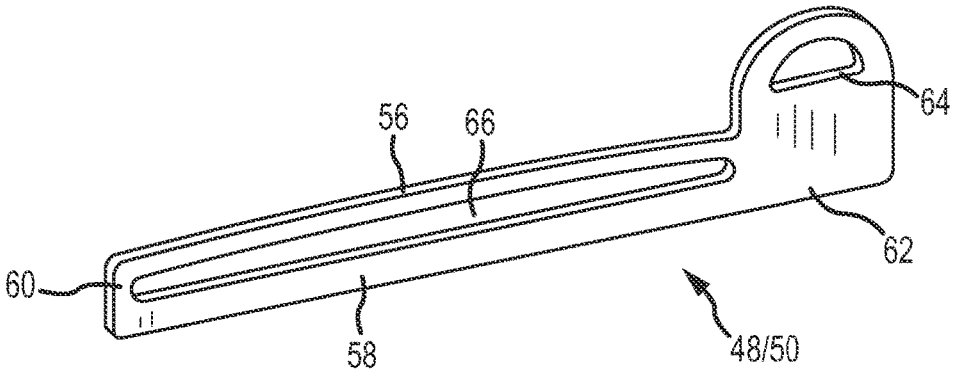
FIG. 5 is an enlarged perspective view of one electrical distribution rail of the muzzle flash simulator shown in FIGS. 2-4.

Each rail 48 and 50 has the same configuration, and that configuration is shown in FIG. 5. Each rail 48/50 has an upper longitudinal bow portion 56 and a lower longitudinal base portion 58 which are joined at opposite ends by vertical transverse end portions 60 and 62. The transverse end portion 62, which is located at inner ends of the bow and base portions 56 and 58 (i.e. further within the flash suppressor 24), is of a substantially larger size compared to the transverse end portion 60. An opening 64 is formed in the larger end portion 62. The opening 64 is used to connect an electrical conductor (84, 86, FIGS. 1 and 4) to the rail 48/50, such as by inserting the conductor through the opening 64 and soldering it to the rail 48/50. The portions 56 and 58 are separated by a longitudinally extending open slot 66.

The upper bow portion 56 of each rail 48/50 has a slight upward convex curvature, compared to the lower base portion 58. When the rails 48 and 50 are inserted into the slots 52 and 54 of the base plate 42 (FIGS. 2 and 3), respectively, the upper bow portion 56 of each rail 48/50 curves convexly above the flat top surface 46 of the base plate 42. The slot 66 provides space to allow the upper bow portion 56 to deflect slightly downward toward the lower base portion 58 when at least one and preferably a plurality of light emitting diode (LED) array devices 68 are physically placed in contact with each of the rails 48 and 50, as shown in FIGS. 2-4.

Figure 6:
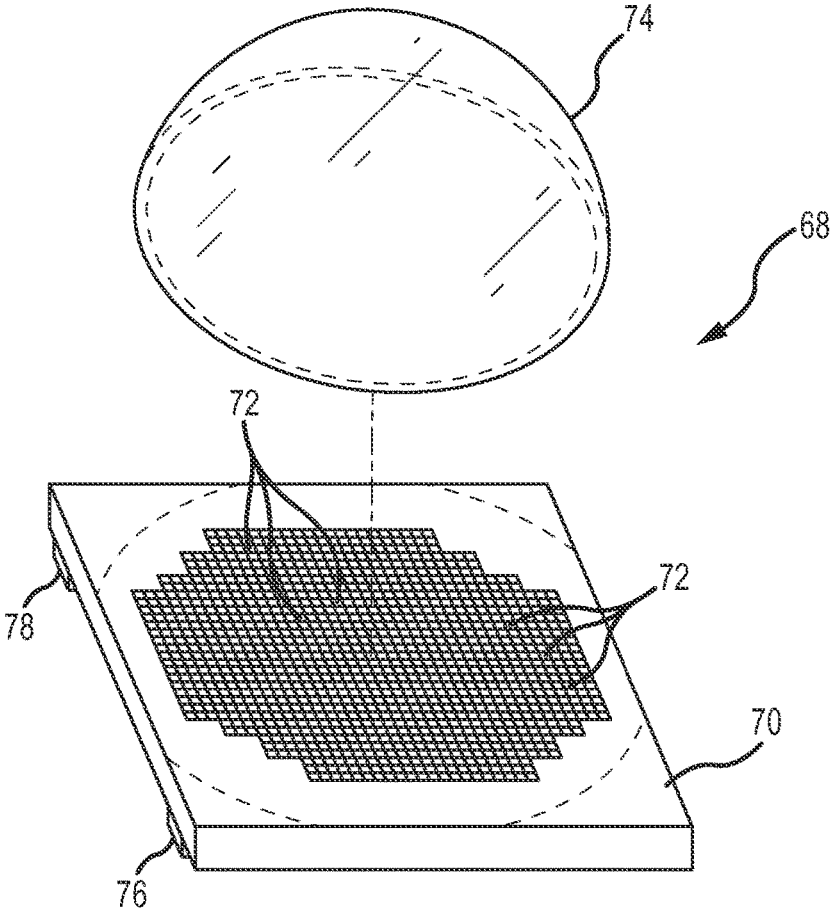
FIG. 6 is an exploded perspective view of an LED array device of the muzzle flash simulator shown in FIGS. 2-4.

Each LED array device 68 is shown in greater detail in FIG. 6. Each LED array device 68 includes a bottom rectangularly shaped substrate 70 on which multiple individual LEDs 72 have been formed in an array using conventional semiconductor fabrication techniques. A convex transparent dome cover or lens 74 is attached to the substrate 70 and surrounds and encloses the array of individual LEDs 72 on the substrate 70. The configuration of the array of the LEDs 72 formed on the substrate 70 is intended to maximize the amount of light generated.

Each individual LED 72 is supplied with electrical energy from conductive traces (not shown) which are formed on the substrate 70 using printed circuit board fabrication techniques. The conductive traces which conduct electrical current to each LED 72 are joined as a single anode electrode 76, and the conductive traces which conduct electrical current from each LED 72 are joined together as a single cathode electrode 78. The anode and cathode electrode 76 and 78 are positioned on the bottom surface of the substrate 70 to contact the bow portions 56 of the rails 48 and 50, respectively, when the muzzle flash simulator 22 is assembled (FIG. 4).

A transparent retaining frame 80 and a transparent glass panel 82 hold each LED array device 68 in contact with the rails 48 and 50, as shown in FIGS. 2 and 3. The retaining frame 80 and the glass panel 82 force the anode electrodes 76 (FIG. 6) of each LED array device 68 into contact with the rail 48 and force the cathode electrode 78 (FIG. 6) of each LED array device 68 into contact with the rail 50. Each LED array device 68 is energized and generates light when an electrical current is conducted from the rail 48 to the anode electrodes 76 and through the individual LEDs 72 of each LED array device 68, and then from the LEDs 72 of each LED array device 68 to the cathode electrodes 78 and from the rail 50. Electrical conductors 84 and 86 are respectively connected to the openings 64 in the large rear transverse portions 62 of the rails 48 and 50 (FIGS. 1 and 4) and carry the electrical current to the rail 48 and carry electrical current from the rail 50. The electrical connectors 84 and 86 extend into the barrel 26 of the gun 20 (FIG. 1) to energize each LED array devices 68 and create the bursts of light from the muzzle flash simulator 22 when a pulse of current is conducted through the conductors 84 and 86.

The retaining frame 80 is attached to the base plate 48 by screws or fasteners 88. A rectangular window 90 is formed in the retaining frame 80 to retain the glass panel 82 therein. Leg portions 92 of the retaining frame 80 elevate the glass panel 82 above the LED array devices 68 in a position to contact the lens 74 (FIG. 6) of each LED array device 68 and force the anode and cathode electrode 76 and 78 (FIG. 6) of each LED array device 68 downward against the bow portions 56 of the rail 48 and 50. The downward force from the glass panel 82 on each LED array device 68 compresses each convex bow portion 56 downward toward the base portion 58 of each rail 48 and 50 (FIG. 5). The reactive force generated by compressing each bowed portion 56 establishes a firm electrical and physical contact between each anode electrode 76 and the rail 48 and between each cathode electrode 78 and the rail 50.

The glass panel 82 is formed from heat resistant transparent material, preferably borosilicate glass. The LED array devices 68 generate considerable heat when they are energized, and the components of the muzzle flash simulator 22 must resist that heat without permanently deforming. The bow portion 56 of the rails 48 and 50 must also resist the heat without permanently deforming and without losing the upward resilient force created by slightly bending the bow portions of the rails downward. Annealing the material from which the rails 48 and 50 are formed assures that the bow portions 56 will not permanently deform and lose their compressive resistance force when heated by energizing the LED array devices 68. The base plate 42 and the tubular housing 32 must also resist the heat generated by the LEDs.

The muzzle flash simulator 22 is connected inside the flash suppressor 24 by screws 94, as understood from FIG. 2. The screws 94 extend through the muzzle flash suppressor 24, the tubular housing 32 and into the base plate 48.

A burst of light from the LED array devices 68 of the muzzle flash simulator 22 is created by delivering a pulse of electrical current through the conductors 84 and 86. The LED array devices 68 immediately generate a burst of light, and that light is emitted from the vent slots 40 of the flash suppressor 24 (FIGS. 2 and 4) in the same manner that the light from the exploded gunpowder of an actual fired ammunition round is emitted when using an actual machine gun. The light is not emitted from the lower vent slots in the flash suppressor. The light from the actual muzzle flash emitted from the lower vent slots in the flash suppressor is not seen by a user of the actual machine gun because that light is blocked by the barrel. The light emitted from the upward facing LED array devices 68 duplicates the effect seen by the user of an actual machine gun when sighting along the top of the barrel. The intensity and sensations of the muzzle flash effectively acclimate the user so that firing an actual machine gun is not surprising or unusual. The blanking effect in night vision goggles is effectively duplicated because of the comparable characteristics of the simulated muzzle flash and an actual muzzle flash.

Use of the many individual LEDs 72 in each of multiple LED array devices 68 creates an intensity in the burst of light from the muzzle flash simulator 22 which is comparable to the intensity of the light generated by firing an actual ammunition round in an actual machine gun. The LED array devices 68 have the capability to generate this comparable amount of light from a relatively small volumetric size, allowing the muzzle flash simulator 22 to be inserted into the flash suppressor 24 of the imitation machine gun 20 and still create a flash of light with a realistic intensity that simulates firing an actual ammunition round. The light source is turned on and off quickly to simulate each muzzle flash without the effects of residual light emission, thereby avoiding the effect of a different sensation compared to firing an actual machine gun. The small size of the LED array devices 68 coupled with their capability to generate high intensity light flashes creates a realistic simulation training experience.

Extra equipment that might adversely influence the training and the ability to effectively use the imitation machine gun is not needed since the muzzle flash simulator 22 is effectively concealed within the flash suppressor 24, thereby achieving substantially the same functionality, performance and physical feel of the actual machine gun which the imitation machine gun emulates. The muzzle flash simulator 22 is conveniently controlled electrically and by the computer systems which are used in the simulated weapons training program. The components of the muzzle flash simulator 22 are reliably capable of repeated and heavy use without premature or unexpected failure. Other advantages and improvements will become apparent upon gaining a full appreciation of the present invention.

The detail of the above description constitutes a description of a preferred example of implementing the invention, and the detail of this description is not intended to limit the scope of the invention except to the extent explicitly incorporated in the following claims. The scope of the invention is defined by the following claims.

The invention claimed is:

1. A muzzle flash simulator for use in an imitation machine gun to simulate a muzzle flash from firing an actual machine gun, the imitation machine gun having a barrel and a flash suppressor with a plurality of vent slots attached to a muzzle end of the barrel, the muzzle flash simulator comprising:

a light source having a plurality of LED array devices which when energized emit a burst of light through the vent slots of the flash suppressor; each LED array device having:

(a) a plurality of LEDs arranged in an array;

(b) an anode electrode through which current is supplied to the plurality of LEDs of the LED array device and a cathode electrode from which current is conducted from the plurality of LEDs of the LED array device; and (c) a pair of current conducting rails to contact the anode electrode and cathode electrode of each LED array device; and a housing within which the light source is positioned, the housing adapted to fit within the flash suppressor.

2. A muzzle flash simulator as defined in claim 1, wherein:

each rail comprises a bow portion and base portion which are separated by a slot, the bow portion extending convexly relative to the base portion; and further comprising:

a base plate having an upper surface which receives the base portion of each rail and positions the bow portion of each rail above the upper surface of the base plate; and wherein:

the anode and cathode electrodes of each LED array device contact the bow portion of each rail above the upper surface of the base plate.

3. A muzzle flash simulator as defined in claim 2 wherein:

each LED array device is pressed against the bow portion of each rail to retain the anode and cathode electrodes of each LED array device in contact with the bow portions of the rails.

4. A muzzle flash simulator as defined in claim 3, wherein:

the convex curvature of the bow portion of each rail is resiliently deformable toward the slot and presses against the anode and cathode electrodes of each LED array device.

5. A muzzle flash simulator as defined in claim 4, wherein:

each LED array device comprises a substrate upon which the plurality of LEDs are formed in an array; and the anode and cathode electrodes are formed on the substrate;

each LED array device comprises a lens attached to the substrate and extending over the array of LEDs formed on the substrate; and pressure is applied to the lens of each LED array device to press the anode and cathode electrodes against the rails.

6. A muzzle flash simulator as defined in claim 5, further comprising:

a glass panel contacting the lens of each LED array device; and a retaining frame which retains the glass panel in contact with the lens of each LED array device, the retaining frame and the glass panel applying the pressure to the lens of each LED array device.

7. A muzzle flash simulator as defined in claim 6, wherein:

the retaining frame is connected to the base plate.

8. A muzzle flash simulator as defined in claim 7, wherein:

the housing is tubular in configuration, the tubular configuration of the housing fits within a cylindrical opening in the flash suppressor, and the tubular housing defines an open interior; and the base plate including the rails and the LED array devices and the glass panel and the retaining device are located within the open interior of the housing.

9. A muzzle flash simulator as defined in claim 8, further comprising:

a disk formed of opaque material positioned at an end of the tubular housing adjacent to a distal end of the cylindrical opening in the flash suppressor.

10. A method of simulating a muzzle flash from firing a live ammunition round from an actual machine gun in an imitation machine gun having a barrel with a flash suppressor attached to a muzzle end of the barrel, wherein the flash suppressor defines a cylindrical interior with vent slots extending from the cylindrical interior to an exterior of the flash suppressor, said method comprising:

locating a light source within the flash suppressor having a plurality of LED array devices located within a cylindrical housing within the cylindrical interior of the flash suppressor, with each LED array device including a plurality of individual LEDs arranged in an array;

using a base plate upon which to support the LED array devices;

conducting electrical energy to the LED array devices through rails retained by the base plate;

pressing the LED array devices into electrical conduct with the rails;

locating the base plate and the rails within the cylindrical housing; and energizing the light source to emit a burst of light through the flash suppressor having an intensity which simulates the intensity of a burst of light from firing a live ammunition round from an actual machine gun.

11. A method as defined in claim 10, further comprising:

using a lens of each LED array device to cover the array of LEDs of each LED array device; and applying pressure to the lens to press the LED array devices into electrical contact with the rails.

* * * * *